United States Patent [19]

Crawford et al.

[11] Patent Number: 5,022,643

[45] Date of Patent: Jun. 11, 1991

[54] UNIVERSAL SIGNATURE FEEDER/CONVEYOR

[75] Inventors: William L. Crawford, Madison Hts.; James M. Morton, Goode, both of Va.

[73] Assignee: CBM Systems Inc., Evington, Va.

[21] Appl. No.: 466,056

[22] Filed: Jan. 16, 1990

[51] Int. Cl.[5] ..... B65H 1/02; B65H 5/04

[52] U.S. Cl. ..... 271/267; 271/149; 198/461

[58] Field of Search ..... 271/147, 148, 149, 84, 271/202, 129, 42, 128, 267; 198/461; 270/54

[56] References Cited

U.S. PATENT DOCUMENTS

| | | | |
|---|---|---|---|
| 2,497,768 | 2/1950 | Hallead . | |
| 3,259,384 | 7/1966 | Hittenberger . | |
| 3,391,769 | 7/1968 | Anderson | 198/461 |
| 3,598,399 | 8/1971 | Cottrell . | |
| 3,635,463 | 1/1972 | Stobb . | |
| 3,712,612 | 1/1973 | Guichard | 271/84 |
| 3,904,022 | 9/1975 | Lutz | 198/580 |
| 3,989,135 | 11/1976 | Pyykonen | 198/461 |
| 4,052,052 | 10/1977 | Müller . | |
| 4,167,227 | 9/1979 | Pichon et al. | 271/149 |
| 4,443,287 | 4/1984 | Worni | 271/202 |
| 4,531,343 | 7/1985 | Wood . | |
| 4,687,092 | 8/1987 | Ray | 198/461 |
| 4,856,645 | 8/1989 | Hollstrom, Jr. . | |

FOREIGN PATENT DOCUMENTS

| | | |
|---|---|---|
| 1183915 | 12/1964 | Fed. Rep. of Germany . |

*Primary Examiner*—H. Grant Skaggs
*Assistant Examiner*—Carol Lynn Drvzbick
*Attorney, Agent, or Firm*—Michael Masnik

[57] ABSTRACT

A signature feeder/conveyor for converting tightly packed signatures into a succession of discrete signatures stacked on edge while moving the signatures while on edge to an end station for delivery thereto upon demand. The feeder/conveyor involves successive stages of walking the signatures on edge in steps to compact the stream of signatures, then loosen the stream, and then substantially sliding the loosened signatures on edge without walking for delivery to the end station. A sensor detects the pressure of loosened signatures approaching the end station for controlling the successive stages of walking the signatures.

18 Claims, 2 Drawing Sheets

UNIVERSAL SIGNATURE FEEDER/CONVEYOR

FIELD OF THE INVENTION

This invention relates, in general, to signature feeder/conveyors adapted to transfer freshly printed signatures, received, for example, from a press room to an end station associated with individual signature processing, such as binder equipment. The invention has particular application in situations where signatures are to be separated from a tightly packed log of signatures while moving in a stream on edge to the end station for delivery thereto upon demand.

BACKGROUND

In the graphic arts industry, signatures (which are sheets oftentimes folded into a "V") are required to be assembled and then bound in book form by a saddle stitcher such as disclosed in McCain U.S. Pat. No 3,087,721. The different signatures are first stacked into tightly packed logs and supplied to respective feeder conveyor stations. The individual signatures are separated from the log and fed to a gathering mechanism such as a chain, moving past the stations, one signature being dropped atop another. Several stations may be involved, each feeding a different signature for one book, or there may be only two active stations. Equipment associated with these stations maybe controlled in many ways: McCain U.S. Pat. Nos. 3,565,422, 3,589,712 and 3,608,893.

Signature machines may be located in a bindery area near the press room, or in an adjacent building. The printed matter, fresh from the press, is bundled into logs and delivered by pallets, or the like, to feeder stations where an attendant takes over. The function of the attendant is to keep the supply stations full with makeup additions. Heretofore, this involves the attendant separating a small stack of signatures from the log, carrying it to the feeder/conveyor and placing it there for manipulation. It is also necessary that the signatures be joggled by the attendant so they will not stick together as a result of friction, static electricity, etc. Even the best worker can get behind or err when separating, carrying and loosening the stacked signatures as an incident to assuring proper feeding of the signature on the feeder/conveyor. Quite often this human error has resulted in human injury, machine stoppage, signature jamming, etc.

SUMMARY

Briefly, in accordance with one embodiment of this invention, there is provided a novel method and apparatus for manipulating signatures, such as folded sheet material, incident to forming such signatures into books. A signature feeder/conveyor converts tightly packed signatures into a succession of discrete signatures stacked on edge while moving the signatures while on edge to an end station for delivery thereto upon demand. The feeder/conveyor involves successive stages of walking the signatures on edge in appropriate steps to first compact the stream of signatures, then loosen the compacted stream and then aligning the loosened signatures by substantially sliding the loosened signatures on edge without walking for delivery to the end station. A sensor detects the pressure of loosened signatures approaching the end station for controlling the successive stages of walking to insure delivery of discrete signatures to the end station upon demand.

Accordingly, a primary object of the present invention is to provide an improved signature feeding mechanism for supplying signatures on demand to book forming equipment.

Another object of this invention is to provide sheet feeding equipment to increase productivity in the field of book forming by apparatus which automatically compacts and then loosens the signatures and feeds them to an end station upon demand.

Another object of the invention is to provide a simple, rugged, and relatively inexpensive device which can deliver signatures to an end station at a predictable and reproducible rate for any desired interval of time.

Another object of the invention is to provide an improved arrangement for advancing signatures available from a log of tightly packed signatures in a substantially continuous stream and then delivering them as individual signatures upon demand to an end station for further handling.

A further object of the invention is to provide a signature feeder/conveyor for converting tightly packed signatures into a succession of discreet signatures stacked on edge while moving the signatures to an end station for delivery thereto upon demand.

A further object of this invention is to minimize injury to human operators of a feeder/conveyor by minimizing the required level of manual handling.

BRIEF DESCRIPTION THE DRAWINGS

These as well as other objects and advantages of this invention will be better understood by careful study of the following detailed description of the presently preferred exemplary embodiment taken in conjuction with the accompanying drawings, of which:

DETAILED DESCRIPTION OF THE INVENTION

Figure 1:
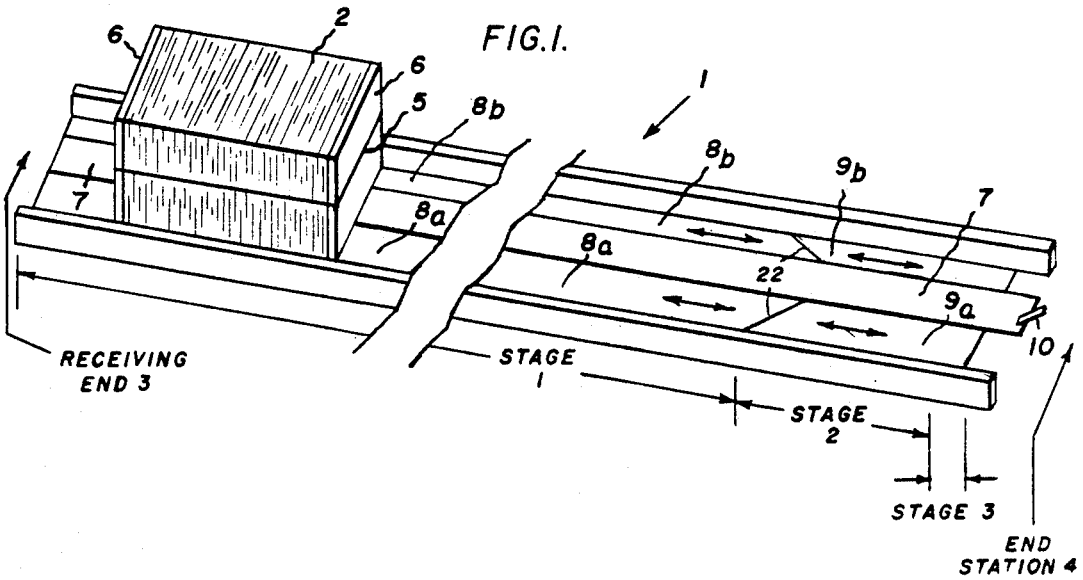
FIG. 1 is a perspective view of a feeder/conveyor constructed in accordance with the present invention.

An exemplary embodiment of the application of the invention is shown in FIG. 1. Here a long feeder/conveyor 1 is provided for supporting and manipulating a stack of upright signatures on edge 2 which are supplied at the receiving end 3 and moved to the end station 4. In a particular application the signatures from the press room are packaged by gathering and binding them into a log form with a strap 5 and rigid end plates 6 (usually made of wood) before being placed on a pallet (not shown). The log is then transferred from the pallet to, for example, the feeder/conveyor 1 associated with a bindary in the case where the signatures are to be assembled into book form. The signatures are provided in log form in order to facilitate movement of the signatures to the bindary. To expedite the overall book generating operation, the logs are tranferred while in bound form to the feeder/conveyor 1 and in particular to the dead plate 7. The purpose of the feeder/conveyor 1 is to separate the signatures which had been compacted into log form into discrete or individual sheets for delivery to the end station. The present invention accomplishes this in 3 stages. For this purpose a plurality of moving, or oscillator plates 8*a*, 8*b* and 9*a*, 9*b* associated with the first and second stages are provided. The oscillator plates 8*a* and 8*b*, and 9*a* and 9*b* straddle the dead plate 7 on either side. The dead plate 1 runs the length of the three stages. The function of the oscillator plates 8*a*, 8*b*, 9*a*, 9*b* is to lift the signatures resting on the dead plate 7 upward, move them forward in walking steps of progressively smaller and then larger increments (to be described) and then deposit them back on to the dead plate. The walking of the signatures with such controlled incremental displacements results in a compacting and then a loosening of the signatures so that they may be removed as individual signatures at the end station 4 for compiling into books. As one baled log of signatures 2 moves down the feeder/conveyor 1, a second log is placed directly behind it, enabling continuous feeding of signatures to the end station. After the first log has moved along the feeder/conveyor 1 and the second log is deposited thereon, an operator or an attendant cuts the strap 5 from the leading log and removes the end plates 6. Initially it is desirable to maintain the signatures in this unstrapped bundle of signatures in a compact form to facilitate rapid movement toward the end plate. Accordingly the signatures pass through the first stage where oscillator plates 8*a* and 8*b* are operated in a manner to walk and thereby compact the signatures. As the unstrapped signatures move along dead plate 7, towards the end station 4 it becomes desirable to begin loosening and settling the individual signatures held in the bundle by friction, electrostatic forces, etc. In this instance accordingly, the signatures pass through a second stage wherein ocillating plates 9*a* and 9*b* are operated in a manner to walk and thereby loosen the signatures. Finally, as the loosened signatures move toward the end station 4 it becomes desirable to still further loosen and also properly settle the signatures on dead plate 7. Accordingly, the signatures pass through a third stage wherein no oscillator plates are provided. The signatures, still stacked on edge, are pushed in response to the back pressure from the following stream of signatures in sliding fashion, without walking, along dead plate 7 to the end station 4. To limit the number of signatures on the dead plate 7 to a small number of loose sheets and to control the number of such loose sheets on demand in accordance with the needs of the end station control means 10 is provided. In a particular embodiment, the end station involved use of a sucker bar which withdrew the individual sheets for assembly into a book as described earlier in the specification.

Figure 2:
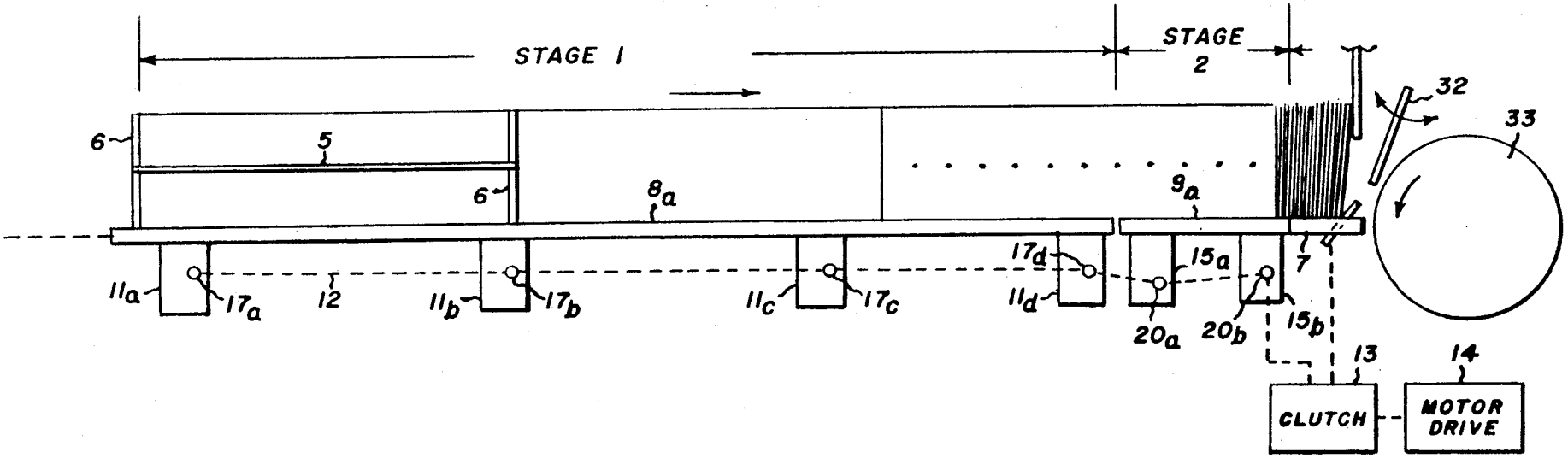
FIG. 2 is a side, elevation view of a feeder/conveyor illustrating the various stages for controlling signature movement while on edge, along the length of the feeder/conveyor.

For further details reference is now made to FIG. 2. To accomplish these various functions the feeder/conveyor 1 is divided into three stages of operation. The first and second stages each comprise two oscillator plates 8*a*, 8*b* and 9*a*, 9*b* respectively with a dead plate 7 mounted in the center. A plurality of pairs of eccentric drives 11 (one of each pair being associated with a respective oscillator plate 8*a* and 8*b*) are driven by a respective chain and sprocket mechanism 12 (shown dotted) from a clutch mechanism 13 coupled to a motor drive 14 in syncronism to cause plates 8 to lift the signatures from the dead plate 7, carry such signatures forward in first given displacements of progressively small increments to be described and return the signatures to the dead plate 7 to thereby move the signatures moving down the feeder/conveyor 1. The oscillator plates 9*a*, 9*b* in the second stage are similarly operated by two pairs of eccentric drives 15*a* and 15*b* to lift the signatures from the second stage section of dead plate 7 carry the signatures forward in second given displacements of progressively large increments before returning the signatures to the dead plate 7 to thereby further move the signatures toward the end station 4. In order to loosen the signatures moving on edge in the second stage, the signatures are moved in discrete walking steps of greater length than those in the first stage but in syncronism therewith along the associated dead plate for delivery to the third stage. To further loosen the stream of signatures into further loosened signatures there is provided a third stage. This third stage comprises the stationary plate or bed 7 but without any oscillator plate associated therewith. Thus the signatures delivered to the third stage from the second stage support the delivered stream of signatures on end and move them in substantially sliding, non-walking movement on edge along a path on this third stage dead plate portion for delivery to the end station 4. At the third stage there is also provided a control means 10 to be described for controlling the delivery on demand of discrete signatures to the end station. This control station responds to the pressure of the further loosened signatures arriving at the end station for controlling the operation of clutch 13 and hence movement of the eccentric drives 11 and 15.

Figure 3A:
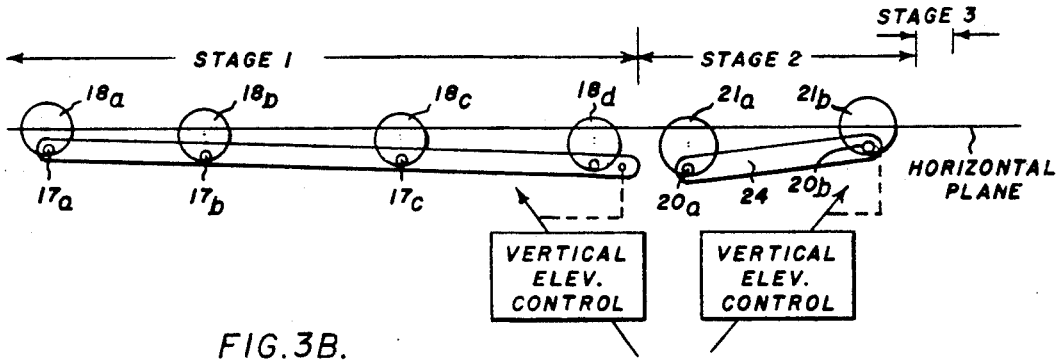
FIG. 3A and 3B are diagrams useful in explaining how signatures are moved in walking steps of progressively smaller, then larger step displacements toward an end station.

The walking of the signatures will now be described in detail. After the strap has been removed from the log in stage 1 and it is permitted to move unstrapped along stage 1 toward stage 2, it is desirable to maintain the signatures compact or compressed during their travel along a first path provided by the dead plate 7 in stage 1. To achieve this, the oscillator plates 8*a* and 8*b* in stage 1 are slightly elevated at their foreward end relative to their rear end with respect to the dead plate 7. This assists in the stage one incremental steps being sequentially, progressly reduced to provide the desired degree of compacting as will be described shortly. The compacting is desirable in order to permit the signatures, after being unstrapped from undergoing undue loosening or falling back and thereby adversely affecting the flow of the signature stream toward stage 2. In a particular embodiment 4 eccentric drives 11*a*, *b*, *c* and *d* spaced along the length of oscillator plate 8*a* were provided. A typical eccentric is shown in FIG. 4 and comprises drive shaft 17 coupled by a sprocket and chain mechanism 11 (shown dotted in FIG. 2) to motor drive 14 by way of clutch 13. Rotation of drive shaft 17 by sprocket and chain mechanism 11 about its axis causes eccentric 18 coupled thereto to move bearing block 19 in two dimensions, vertical and lateral as shown by the arrows. Oscillator plate 8*a* coupled to its block 19 therefore undergoes oscillatory movement involving lifting signatures thereon from the dead plate 7, moving them forward before depositing them back down on the dead plate 7. To provide such walking action along the length of the dead plate 7, 4 such eccentric drives 11*a–d* were provided, spaced along the length of the plate 8*a* and 2 eccentric drives 15*a*, *b* along the length of plate 9*a*. To permit compacting of signatures during their movement by plate 8*a*, the displacement increments of the walking steps in stage 1 in the direction of stage 2 are progressively shortened. This was accomplished in one embodiment by progressively lowering the position of the drive shafts 17*a, b, c, d* in stages 1 with respect to the plane of the dead plate 7 as shown in FIGS. 2 and 3. This resulted in decreasing the vertical and lateral displacements of the oscillator plate 8*a* with respect to dead plate 7. To permit loosening of signatures during their movement along plate 9*a*, the displacement increments of the walking steps in stage 2 in the direction of stage 3 are progressively lengthened. This was accomplished in one embodiment by raising the position of drive shaft 20*b* relative to that of shaft 20*a* with respect to the plane of the dead plate 7 in stage 2. Additionally the diameter of both eccentrics 21 in stage 2 were increased with respect to those in stage 1. This resulted in increasing the vertical and lateral displacements of the oscillator plate 9*a* with respect to dead plate 7. To enable a smooth transition of signature movement from stage 1 to stage 2, the oscillator plates 8*a* and 9*a* had their adjoining ends adjusted to be in substantially the same plane at their most elevated positions with respect to dead plate 7. From this position the adjoining end of plate 8*a* trails the falling of the adjoining end of 9*a* past the dead plate 7 and leads the rising of the adjoining end of 9*a* past the dead plate 7. This insures that the moving signatures never encounter the obstacle of a higher elevation oscillator plate in moving along the dead plate 7 in the transition from stage 1 to stage 2. To further facilitate the smooth transfer of signatures without obstacles from stage 1 to stage 2, the adjoining ends of oscillator plates 8*a* and 9*a* are mated at a bias as shown by numeral 22. As soon as a signature is picked up by the oscillator plate 9*a* it is raised to the same height as the following signature on oscillator plate 8*a*, but it is moved forward a greater displacement increment than that of the following signature. These increments of displacement are progressively increased and thereby signatures are progressively loosened until they arrive at stage 3.

Figure 3B:
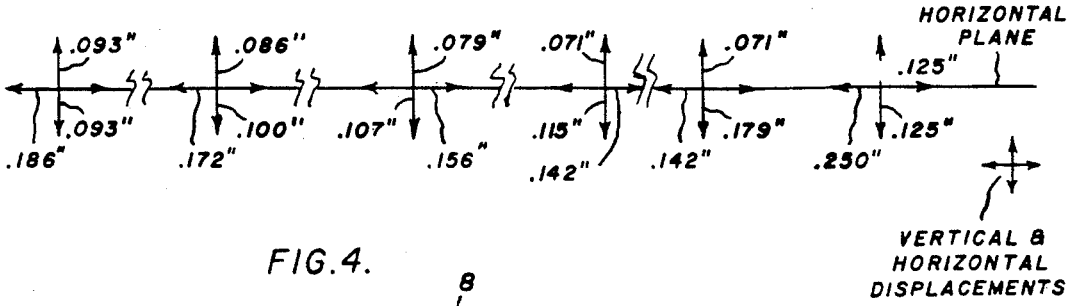
Figure 4:
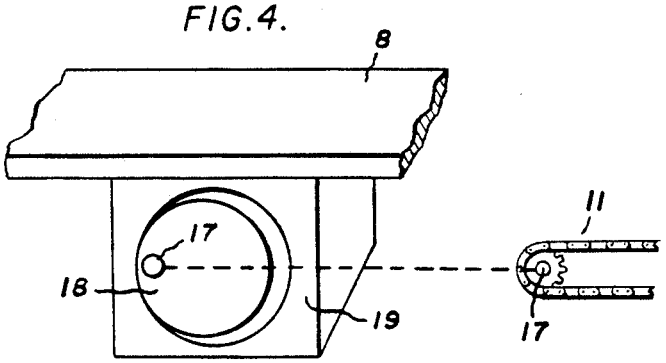
FIG. 4 illustrates the operation of an exemplary eccentric drive for carrying out the invention.

FIG. 3*b* illustrates the vertical and lateral displacements of signatures taking place synchromously in one embodiment as the signatures progress along dead plate 7 in stages 1 and 2 of the feeder/conveyor 1.

For purposes of simplicity the explanation of the eccentric drives and signature walking action has been described with respect to plates 8*a* and 9*a*. However the same explanation applies to 8*b* and 9*b* located on the opposing side of the dead plate 7. Furthermore all the eccentrics are driven in synchronism by a chain and sprocket drive mechanism 12 and from a common drive motor 14 associated with a clutch 13.

Figure 5:
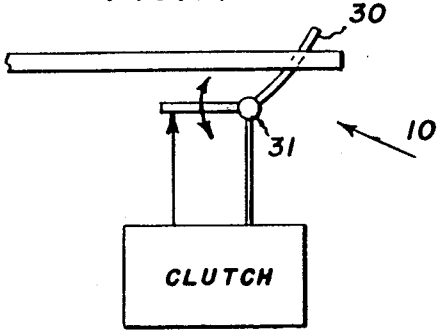
FIG. 5 illustrates the detail operation of an exemplary sensor for controlling the feeding of signatures on demand.

Finally, the loosened signatures from stage 2 arrive at stage 3 (see FIG. 1 and 2). As shown in the drawings there are no oscillator plates associated with this stage and therefore the signatures are permitted to move along this path to the end station in response to the pressure level of the following signatures. The movement is one of the signatures moving slidingly along the dead plate in response to back pressure of the arriving sheets but without any walking action. This permits the signatures to be loosened further and to be aligned desirably on the stage 3 dead plate for arrival at the end station 4. To achieve the desired flow of signatures in one particular embodiment, stage 1 was dimensioned to be some 9 feet long, stage 2 of the order of 1 foot and stage three of the order of three inches. Four eccentric drives were provided for each of the oscillator plates 8*a* and 8*b* and two for each of plates 9*a* and 9*b*. These eccentric drives were driven by a motor drive 14 through a clutch 13 and a chain and sprocket arrangement 12, indicated generally by dashed lines in FIG. 2, as is well known in the art. The eccentrics 21 were selected to be the same size but larger than eccentrics 18, (see FIG. 3*a*) which were also all of the same size. Common elevator rods 23 and 24 coupled to the shafts 17 and 20 respectively, adjust the position of the associated bearing blocks 11 and 15 and hence the angle of inclination or declination of the oscillator plates 8 and 9 with respect to the dead plate 7 to provide the desired compacting or loosening. Referring to FIG. 5, the loosened, esentially separated signatures arriving and moving along stage 3 intercept a sensor 30 in control means 10. As the pocket is running and the signature material is being fed, the sensor 30 in motor control 10 detecting an over-adequate supply of signatures, causes switch 31 to open its contacts and thereby operate clutch 14 to disengage the chain and sprocket mechanism 12 from the motor 14 and thereby halt oscillation of the oscillator plates 8 and 9. As the pocket is running and the signatures are being fed, the sensor detecting a need for more signatures, causes the switch 31 to close its contacts thereby causing the clutch 13 to be engaged for driving the oscillator plates 8 and 9 and move the signatures forward until the trigger switch is again closed by the pressure of the flowing signatures. In a particular embodiment involving the delivery of logs of 40 inch length, the feeder/conveyor was designed to have a dead plate path in stage 1 of some 9 feet, a stage 2 path of some 12 inches and a stage 3 path of some 3 inches. This arrangement enabled a substantially continuous movement of about 3 logs of signatures for delivery on demand to an end station 4 with a minimum of attendant care. At the end station 4 (FIG. 2), the arriving signatures loosened in stages 2 and 3 are picked up by a sucker bar and gripper arrangement (shown symbolically as 32) in a well known fashion and delivered to a drum 33 for delivery to a moving transport chain, (not shown), for example, which would carry this separated sheets for combining with other separated sheets being delivered at other feeder/conveyor stations for ultimate stapling together at their folds into a book.

While given dimensions have been mentioned in connection with the particular embodiments described, it is obvious they could be modified to accomodate different enviromental situations. For example, the signatures may be thick or thin or they may involve one or more sheets of folded paper as for example, newspapers. One would then change the increments of displacement in stages 1 and 2 to accomodate these changes. A thicker signature would require overall longer displacements. Similarly while an eccentric/sprocket chain drive has been described, it obviously that other arrangements such as pneumatic drives and lever control displacement mechanisms could be employed to achieve in effect the walking action of lifting the signatures from the dead plate, moving them forward and then dropping them back on the dead plate. Also while in this particular embodiment the eccentric action resulted in a period of stepping signature movement followed by a period of no signature movement (when the oscillator plates moved below the plane of the dead plate 7) with the signatures resting on the dead plate 7—in certain applications the stepping action may be continuous without the resting period or the stepping/resting period ratio may be varied. In the embodiment described, the resting period provided an interim for the individual signatures in the bundle or in the stream of signatures to settle on the dead plate on edge in desirable alignment for removal at the end station. Although only one exemplary embodiment of the invention has been described in detail, those skilled in the arts will require that many modifications and variations may be made in this embodiment while yet retaining many of the novel features and advantages of this invention. Accordingly, all such variations and modifications are intended to be included within the scope of the appended claims.

What is claimed is:

1. Apparatus for manipulating signatures wherein successive signatures of an expiring stack of tightly packed signatures stacked on edge are converted into a succession of discrete signatures stacked on edge and delivered to an end station comprising a conveyor, said conveyor comprising first, second and third stages, said first stage comprising a first stationary bed for supporting a stream of tightly packed signatures on edge, said first stage comprising first means for moving said supported signatures in discrete first walking steps of given length along said first bed for delivery to said second stage, means for loosening said delivered stream of signatures comprising said second stage, said second stage comprising a second stationary bed for supporting said delivered stream of signatures on edge, said second stage comprising second means for moving said supported signatures in discrete second walking steps each of given length greater than said first mentioned given length but in synchronism therewith along said second bed for delivery to said third stage, means for further loosening said delivered loosened stream of signatures into further loosened signatures comprising said third stage, said third stage comprising a third stationary bed for supporting said delivered stream of further loosened signatures on edge, third means for controlling movement of said supported, further loosened signatures in substantially sliding, non walking movement on edge along said third bed for delivery to said end station.

2. An arrangement according to claim 1 wherein said first and second means each comprise a plurality of moveable beds associated with each of said first and second stationary beds and means for lifting the signatures off of such associated stationary beds, moving them forward toward such end station and then depositing them back down on such associated stationary beds.

3. An arrangement according to claim 2 wherein said first and second means further comprise drive means for moving the plurality of moveable beds associated with said first and second means, in respective arcuate paths above and below the planes of their associated stationary beds in synchronism.

4. An arrangement according to claim 1 wherein said third means comprising control means for controlling the delivery on demand of discrete signatures to said end station, said control means responsive to the pressure of further loosened signatures arriving at said end station for controlling the occurrences of said first and second step movements.

5. An arrangement according to claim 4 wherein said control means comprises a sensor for sensing the level of pressure of signatures being delivered to said end station for controlling the start-stop operation of said first and second means.

6. Apparatus for manipulating signatures wherein tightly packed signatures stacked on edge are converted into a succession of discrete signatures stacked on edge for movement toward an end station comprising a conveyor, said conveyor comprising first and second stages, means for tightening signatures comprising said first stage, said first stage comprising first means operable for moving signatures while stacked on edge in discrete walking steps of sequentially progressively smaller length along a first path for delivery to said second stage, means for loosening said delivered stream of signatures comprising said second stage, said second stage comprising second means operable for moving said signatures while stacked on edge in discrete walking steps of length greater than said smaller lengths along a second path for movement toward said end station.

7. An arrangement according to claim 6 comprising a third stage, means for further loosening said delivered, loosened stream of signatures into discrete further loosened signatures for delivery to said end station comprising said third stage, said third stage comprising means enabling the pushing of signatures while stacked on edge in a forward direction along a third path toward said end station in response to back pressure from the following stream of signatures, and control means responsive to movement of signatures along said third path for controlling the operation of said first and second means.

8. Apparatus for manipulating signatures wherein tightly packed signatures stacked on edge are converted into a succession of discrete signatures stacked on edge for movement toward end station comprising a conveyor, said conveyor comprising first and second stages, said first stage comprising first means operable for moving said signatures while stacked on edge in discrete first walking steps of given length along a horizontal plane for delivery to said second stage, means for loosening said delivered stream of signatures comprising said second stage, said second stage comprising second means operable for moving said signatures while stacked on edge in discrete second walking steps of given length greater than said first mentioned given length along said plane for movement toward said station.

9. An arrangement according to claim 8 comprising a third stage, means for further loosening said delivered, loosened stream of signatures into discrete further loosened signatures for delivery to said end station comprising said third stage, said third stage comprising third means enabling the pushing of said signatures while stacked on edge along said plane toward said end station in a sliding, non-walking movement in response to back pressure from the following stream of signatures.

10. An arrangement according to claim 9 further comprising control means for controlling on demand the delivery of said still further loosened signatures to said end station comprising means responsive to said sliding, nonwalking movement of signatures along said plane for controlling the operation of said first and second means.

11. An arrangement according to claim 10 wherein said operating first means comprises means for moving signatures while stacked on edge in discrete first walking steps of progressively smaller increments along the plane of said stationary bed.

12. An arrangement according to claim 10 wherein the path of said first walking steps is of a substantially greater length along said plane than the path of said second walking steps, which in turn is of a substantially greater length than the path in said third stage.

13. An arrangement according to claim 12 wherein the ratio of the lengths of said first, second and third mentioned paths are of the order of 50:5:1 respectively.

14. An arrangement according to claim 8 wherein said first stage and second stages each comprise a plurality of signature supporting moveable beds associated with a stationary bed located in a given horizontal plane, first operating means for operating said first stage moving beds to lift signatures from said stationary bed, carry such signatures forward in first given displacement increments and return such signatures to said stationary bed, second operating means for operating said second stage moving beds to lift signatures from said stationary bed, carry such signatures forward in second given displacement increments and return such signatures to said stationary bed, said second displacement increments being longer than said first displacement increments, and control means controlling the operation of said first and second operating means to be substantially in synchronism.

15. An arrangement according to claim 14 wherein said first and second operating means comprise driving means for moving said first and second stage moving beds in arcuate traversal above and below the plane of said stationary bed.

16. An arrangement according to claim 15 wherein said first stage moving beds lead said second stage moving beds in their traversals from below to above the plane of said stationary bed.

17. An arrangement to claim 15 wherein the arcuate traversals of said second moving beds are longer than that of said first moving beds.

18. An arrangement according to claim 17 wherein said second stage moving beds lead said first stage moving beds in their traversals from above to below the plane of said stationary bed.

* * * * *